US010215063B2

(12) United States Patent
Okamoto

(10) Patent No.: US 10,215,063 B2
(45) Date of Patent: Feb. 26, 2019

(54) VALVE GEAR FOR ENGINE AND METHOD OF MANUFACTURING ROCKER ARMS

(71) Applicant: YAMAHA HATSUDOKI KABUSHIKI KAISHA, Iwata-shi, Shizuoka (JP)

(72) Inventor: Yasuo Okamoto, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 89 days.

(21) Appl. No.: 15/516,034

(22) PCT Filed: Oct. 2, 2015

(86) PCT No.: PCT/JP2015/078052

§ 371 (c)(1),
(2) Date: Mar. 31, 2017

(87) PCT Pub. No.: WO2016/052729

PCT Pub. Date: Apr. 7, 2016

(65) Prior Publication Data

US 2017/0298787 A1 Oct. 19, 2017

(30) Foreign Application Priority Data

Oct. 3, 2014 (JP) ..... 2014-205094

(51) Int. Cl.
*F01L 1/34* (2006.01)
*F01L 1/18* (2006.01)
(Continued)

(52) U.S. Cl.
CPC ..... *F01L 1/185* (2013.01); *F01L 1/047* (2013.01); *F01L 1/146* (2013.01); *F01L 1/18* (2013.01);
(Continued)

(58) Field of Classification Search
CPC ... F01L 1/185; F01L 1/047; F01L 1/18; F01L 1/267; F01L 1/46; F01L 13/00; F01L 13/0036; F01L 2001/0537; F01L 2001/186; F01L 2001/467; F01L 2103/00; F01L 2103/01; F01L 2105/00
See application file for complete search history.

(56) References Cited

U.S. PATENT DOCUMENTS 4,611,558 A 9/1986 Yoshizaki et al.
5,669,342 A * 9/1997 Speil ..... F01L 1/18 123/198 F
(Continued)

FOREIGN PATENT DOCUMENTS

DE 195 36 090 A1 4/1997
EP 0 318 303 A1 5/1989
(Continued)

OTHER PUBLICATIONS

Official Communication issued in International Patent Application No. PCT/JP2015/078052, dated Dec. 22, 2015.

*Primary Examiner* — Zelalem Eshete
(74) *Attorney, Agent, or Firm* — Keating and Bennett, LLP

(57) ABSTRACT

A valve gear for an engine includes a camshaft including a cam, a rocker shaft, and a first rocker arm which swings when pressed by the cam. The valve gear includes a spring, which biases the first rocker arm and a second rocker arm which presses an intake valve or an exhaust valve, in a return direction. The valve gear includes a first pin hole of the first rocker arm, a second pin hole and a third pin hole of the second rocker arm, a first switch pin, a second switch pin, a third switch pin, and a switch which switches between a connected state and a non-connected state of the switch pins. The second rocker arm includes a stopper against which the first rocker arm abuts. When the first rocker arm abuts against the stopper, all of the pin holes are located on the same axis.

6 Claims, 11 Drawing Sheets

(51) Int. Cl.

| | |
|---|---|
| ***F01L 13/00*** | (2006.01) |
| ***F01L 1/26*** | (2006.01) |
| ***F01L 1/047*** | (2006.01) |
| ***F01L 1/14*** | (2006.01) |
| *F01L 1/053* | (2006.01) |
| *F01L 1/46* | (2006.01) |

(52) U.S. Cl.
CPC ..... *F01L 1/267* (2013.01); *F01L 13/00* (2013.01); *F01L 13/0036* (2013.01); *F01L 2001/0537* (2013.01); *F01L 2001/186* (2013.01); *F01L 2001/467* (2013.01); *F01L 2103/00* (2013.01); *F01L 2103/01* (2013.01); *F01L 2105/00* (2013.01)

(56) References Cited

U.S. PATENT DOCUMENTS

| | | | |
|---|---|---|---|
| 5,680,835 | A | 10/1997 | Ruffing et al. |
| 2007/0028879 | A1 | 2/2007 | Roerig et al. |
| 2014/0083380 | A1 | 3/2014 | Hiramatsu et al. |

FOREIGN PATENT DOCUMENTS

| | | | |
|---|---|---|---|
| EP | 2 711 510 | A1 | 3/2014 |
| JP | 61-122308 | U | 8/1986 |
| JP | 61-250318 | A | 11/1986 |
| JP | 1-176704 | U | 12/1989 |
| JP | 086569 | B2 | 1/1996 |
| JP | 10-18826 | A | 1/1998 |
| JP | 2014-062500 | A | 4/2014 |

* cited by examiner

VALVE GEAR FOR ENGINE AND METHOD OF MANUFACTURING ROCKER ARMS

BACKGROUND OF THE INVENTION

1. Field of the Invention

The present invention relates to a valve gear for an engine that switches between an operation in which two types of rocker arms are connected to each other and an operation in which the rocker arms are disconnected, and a method of manufacturing the rocker arms.

2. Description of the Related Art

A conventional type of valve gear for an engine is described in, for example, Japanese Patent Publication No. 8-6569. The valve gear disclosed in Japanese Patent Publication No. 8-6569 converts the rotation of a camshaft into a reciprocating motion using rocker arms, and drives two intake or exhaust valves.

The camshaft includes a high-speed cam and two low-speed cams located on two sides of the high-speed cam. The high-speed cam has a shape that relatively increases a valve lift amount more than that of the low-speed cams.

The rocker arm includes two main arms of the respective intake or exhaust valves, and a sub arm located between the main arms.

Each main arm includes a slipper which the low-speed cam of the camshaft contacts, and is swingably supported by a rocker shaft. The main arm is biased against the low-speed cam by the valve spring of the corresponding intake or exhaust valve.

The sub arm includes a slipper which the high-speed cam of the cam shaft contacts, and is swingably supported by the rocker shaft. The sub arm is biased against the high-speed cam by a dedicated return spring. These main arms and sub arm are integrated by being connected to each other by a hydraulic switch, and are disconnected and separated.

The switch includes a switch pin movably provided in the pin hole of the sub arm, plungers respectively movably provided in the plunger holes of the two main arms, a hydraulic circuit that supplies an oil pressure to the plungers, and the like. The switch pin and the two plungers are located on the same axis when the intake or exhaust values are closed.

The main arms and sub arm are integrated when one of the plungers presses the switch pin and the other plunger. In this example, one plunger is fitted in the pin hole of the sub arm and located across one main arm and the sub arm. The switch pin is fitted in the plunger hole of the other main arm and located across the sub arm and the other main arm. When the main arms and the sub arm are in a connected state, the main arms operate together with the sub arm pressed by the high-speed cam, thus driving the intake or exhaust valves.

To separate the main arms and the sub arm, the switch pin is pressed back by the other plunger to a state in which one plunger is located in only the main arm and the switch pin is located in only the sub arm. When a non-connected state is set by separating the sub arm and the main arms, the sub arm pressed by the high-speed cam solely swings, and the main arms pressed by the low-speed cams drive the intake or exhaust valves.

The valve gear described in Japanese Patent Publication No. 8-6569 has difficulty locating the switch pin and the two plungers on the same axis in a state in which the intake or exhaust valves are closed. If the switch pin and the plungers are not located on the same axis, they are difficult to move. Consequently, it is impossible to readily and reliably switch between an operation in which the main arms and the sub arm are connected and an operation in which the arms are separated. To reliably perform switching, it is necessary to apply a high oil pressure to the plungers. As a result, the switch pin is strongly rubbed against the main arms, and the plungers are strongly rubbed against the sub arm, thus degrading the reliability of the switch. In addition, the components defining the switch need to be robust, thus increasing the size of the switch and the manufacturing cost.

SUMMARY OF THE INVENTION

Preferred embodiments of the present invention provide a valve gear for an engine in which a switch pin readily moves when switching between an operation wherein two types of rocker arms are connected and an operation wherein the rocker arms are separated, and a method of manufacturing the rocker arms used for the valve gear.

According to a preferred embodiment of the present invention, a valve gear for an engine includes a camshaft including a cam that drives one of an intake valve and an exhaust valve, a rocker shaft parallel or substantially parallel to the camshaft, a first rocker arm swingably supported by the rocker shaft and that swings when being pressed by the cam, a spring that biases the first rocker arm in a return direction opposite to a direction in which the first rocker arm swings when being pressed by the cam, a second rocker arm swingably supported by the rocker shaft and in which a valve pressing portion that presses one of the intake valve and the exhaust valve is provided at a swing end, pin holes that are parallel or substantially parallel to an axis of the rocker shaft, and that are each located at equidistant or substantially equidistant positions in the first rocker arm and the second rocker arm from the rocker shaft, a switch pin in the pin hole that is movable in an axial direction of the rocker shaft, and a switch that switches between a connected state, in which the switch pin crosses the first rocker arm and the second rocker arm, and a non-connected state, in which the switch pin never crosses the rocker arms, by moving the switch pin in the axial direction, wherein the second rocker arm includes a stopper against which the first rocker arm, which swings in the return direction, abuts in the non-connected state and in a state in which one of the intake valve and the exhaust valve is closed, and when the first rocker arm abuts against the stopper, all of the pin holes are located on the same axis.

According to a preferred embodiment of the present invention, a method of manufacturing rocker arms for a valve gear for an engine in which a cam follower of a first rocker arm, that a cam contacts, is a rotation member, the rotation member is rotatably supported by a support shaft fitted in a shaft hole of the first rocker arm, and a hollow portion defining a pin hole of the first rocker arm is included in the support shaft, includes fitting a cylindrical jig, instead of the support shaft, in the shaft hole of the first rocker arm, an outer diameter of the cylindrical jig fitting into the shaft hole of the first rocker arm and an inner diameter matching that of a pin hole of a second rocker arm, fitting one rod-shaped jig, instead of the switch pin, in the pin hole of the second rocker arm and the hollow portion of the cylindrical jig, holding the first rocker arm in a state in which the first rocker arm abuts against a stopper of the second rocker arm, and drilling through the first rocker arm and the second rocker arm to provide a hole for the rocker shaft.

According to a preferred embodiment of the present invention, the first rocker arm is biased by a spring in a direction in which it moves closer to a cam. In a state in which switch pins are in a non-connected state and an intake or exhaust valve is closed, the first rocker arm swings by the spring force of the spring to abut against the stopper of the second rocker arm. At this time, all the switch pins are located on the same axis.

Therefore, according to a preferred embodiment of the present invention, it is possible to provide a valve gear for an engine in which switch pins readily and reliably move when switching between an operation wherein the first and second rocker arms are connected and an operation wherein the rocker arms are separated.

In a method of manufacturing rocker arms according to a preferred embodiment of the present invention, even though a hole located in the first rocker arm is a shaft hole larger than a pin hole, and a hole located in the second rocker arm is a pin hole, the first and second rocker arms are structured so that these holes are located on the same axis in an assembled state. The assembled state indicates a state in which the first and second rocker arms are supported by a rocker shaft and the first rocker arm abuts against a stopper. Consequently, by assembling a valve gear using the rocker arms manufactured by the method of manufacturing described above, it is possible to more readily and reliably perform the above-described switching.

The above and other elements, features, steps, characteristics and advantages of the present invention will become more apparent from the following detailed description of the preferred embodiments of the present invention with reference to the attached drawings.

DETAILED DESCRIPTION OF THE PREFERRED EMBODIMENTS

First Preferred Embodiment

A first preferred embodiment of the present invention provides a valve gear for an engine and a method of manufacturing rocker arms as will be described in detail below with reference to FIGS. 1 to 14.

Figure 1:
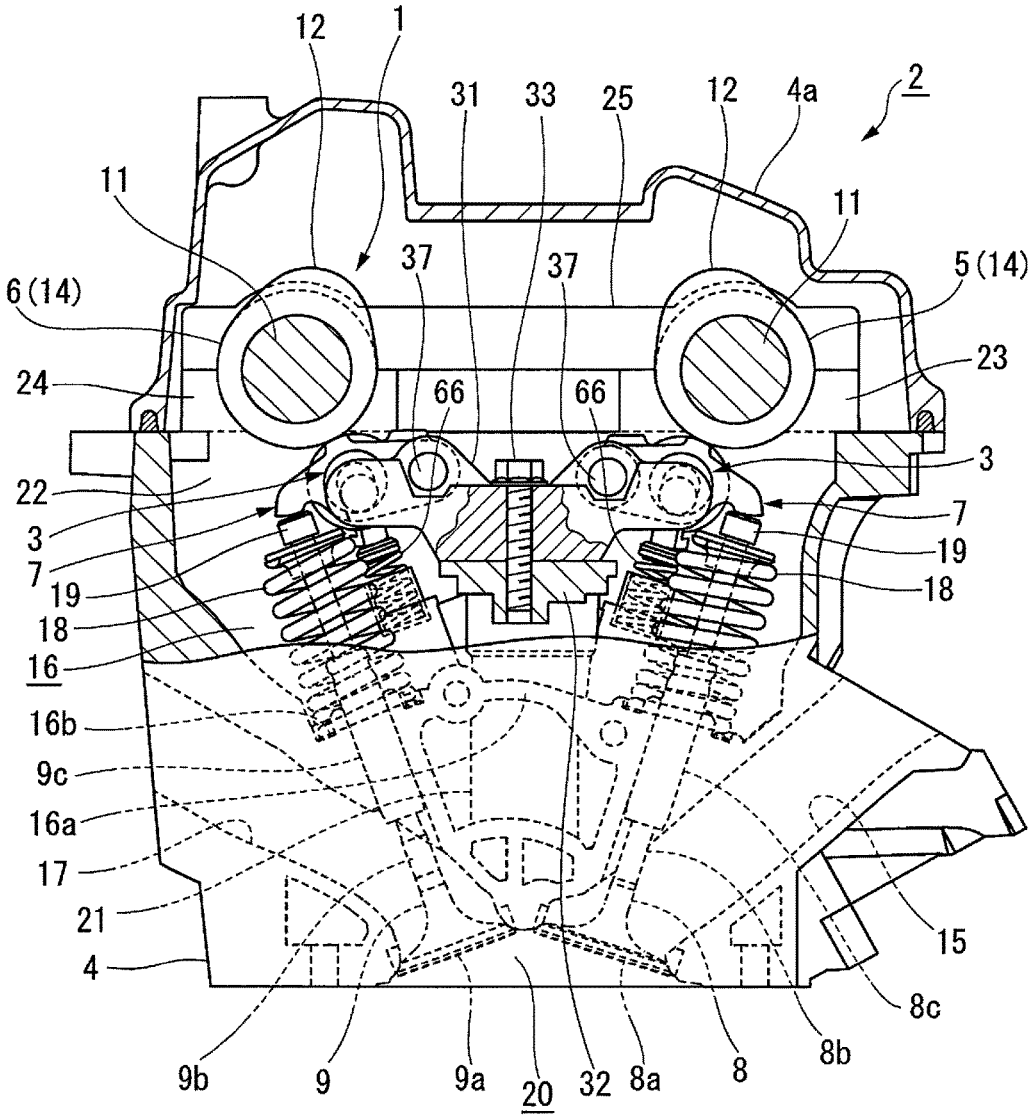
FIG. 1 is a side view showing a valve gear according to a first preferred embodiment of the present invention, and shows a state in which a cylinder head and a rocker housing are partially cut away.
Figure 2:
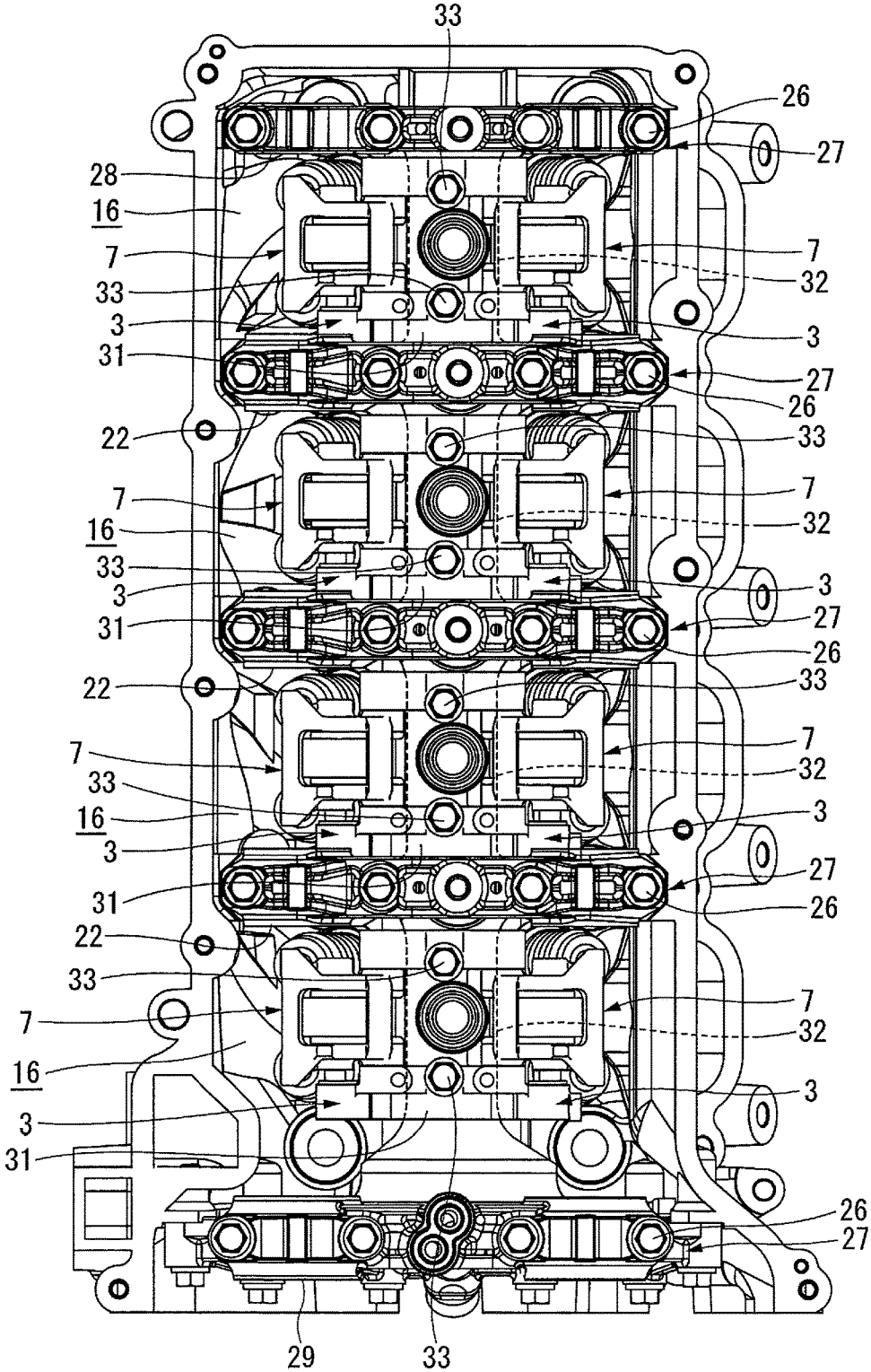
FIG. 2 is a plan view showing the cylinder head, and shows a state in which an intake camshaft and an exhaust camshaft are detached.

A valve gear 1 shown in FIG. 1 is mounted on, for example, a DOHC four-cylinder engine 2 included in a vehicle. The valve gear 1 includes switches 3 (see FIG. 2) to switch among a plurality of operations (to be described later). The switches 3 switch preferably between an operation in which cylinders are operated as usual and an operation in which the cylinders are at rest, as will be described later in detail. The switches 3 shown in FIG. 2 are provided on the intake valve side (the right side in FIG. 2) and the exhaust valve side (the left side in FIG. 2) of all the cylinders.

The operations selected by the switches 3 include a full cylinder operation in which the four cylinders are operated as usual and a partial cylinder operation in which only an arbitrary cylinder among the four cylinders is operated. FIG. 2 shows a state in which the switches 3 are provided in all the cylinders so as to change the number of cylinders operated when the partial cylinder operation is used. When the partial cylinder operation is used, if only one of the four cylinders is operated, one-cylinder operation is set. If only two of the four cylinders are operated, a ½ reduced cylinder operation is set. If only three of the four cylinders are operated, a three-cylinder operation is set. If the four cylinders are at rest, a full cylinder rest operation is set.

If the one- or three-cylinder operation is used, an arrangement is used in which a cylinder to be operated is determined and selected based on a predetermined rule and all the cylinders are equally operated.

The ½ reduced cylinder operation is able to be implemented in the first and second operations in which different cylinders are operated. In the first operation, a cylinder (first cylinder) located at one end in a direction in which the four cylinders are arranged, and the fourth cylinder from the one end are operated. In the second operation, the second and third cylinders from one end in the direction in which the four cylinders are arranged are operated.

If only the ½ reduced cylinder operation and the full cylinder operation are selected, the switches 3 are generally mounted on only the cylinders which are at rest. If the switches 3 are provided in all the cylinders, it is possible to alternately switch, based on the predetermined rule, between the ½ reduced cylinder operation by the first operation and by the second operation. For example, since all the cylinders are almost equally operated by frequent switching between the first operation and the second operation, the temperature distribution of the engine is uniform or substantially uniform although the ½ reduced cylinder operation is used.

The full cylinder rest operation is selected when, for example, an accelerator is turned off. If the full cylinder rest operation is used, only adiabatic compression and adiabatic expansion are repeated in each cylinder, and there is no intake or exhaust to or from a combustion chamber, thus decreasing a pumping loss.

As shown in FIG. 1, the valve gear 1 includes the switches 3 according to the present preferred embodiment. The valve gear 1 converts the rotations of an intake camshaft 5 and an exhaust camshaft 6, both of which are provided in a cylinder head 4, into reciprocating motions using rocker arms 7 in the cylinder when operated normally, thus driving an intake valve 8 and an exhaust valve 9.

A portion which drives the intake valve 8 and a portion which drives the exhaust valve 9 in the valve gear 1 preferably have the same structure or substantially the same structure. For this reason, for elements which have the same structure on the side of the intake valve 8 and on the side of the exhaust valve 9, the element on the side of the exhaust valve 9 will be described. The element on the side of the intake valve 8 is denoted by the same reference number and a description thereof will be omitted.

Each of the intake camshaft 5 and the exhaust camshaft 6 includes a camshaft main body 11 rotatably supported in the cylinder head 4, and a cam 12 provided on the camshaft main body 11. Note that the intake camshaft 5 and the exhaust camshaft 6 will generally be referred to as camshafts 14 hereinafter.

Figure 3:
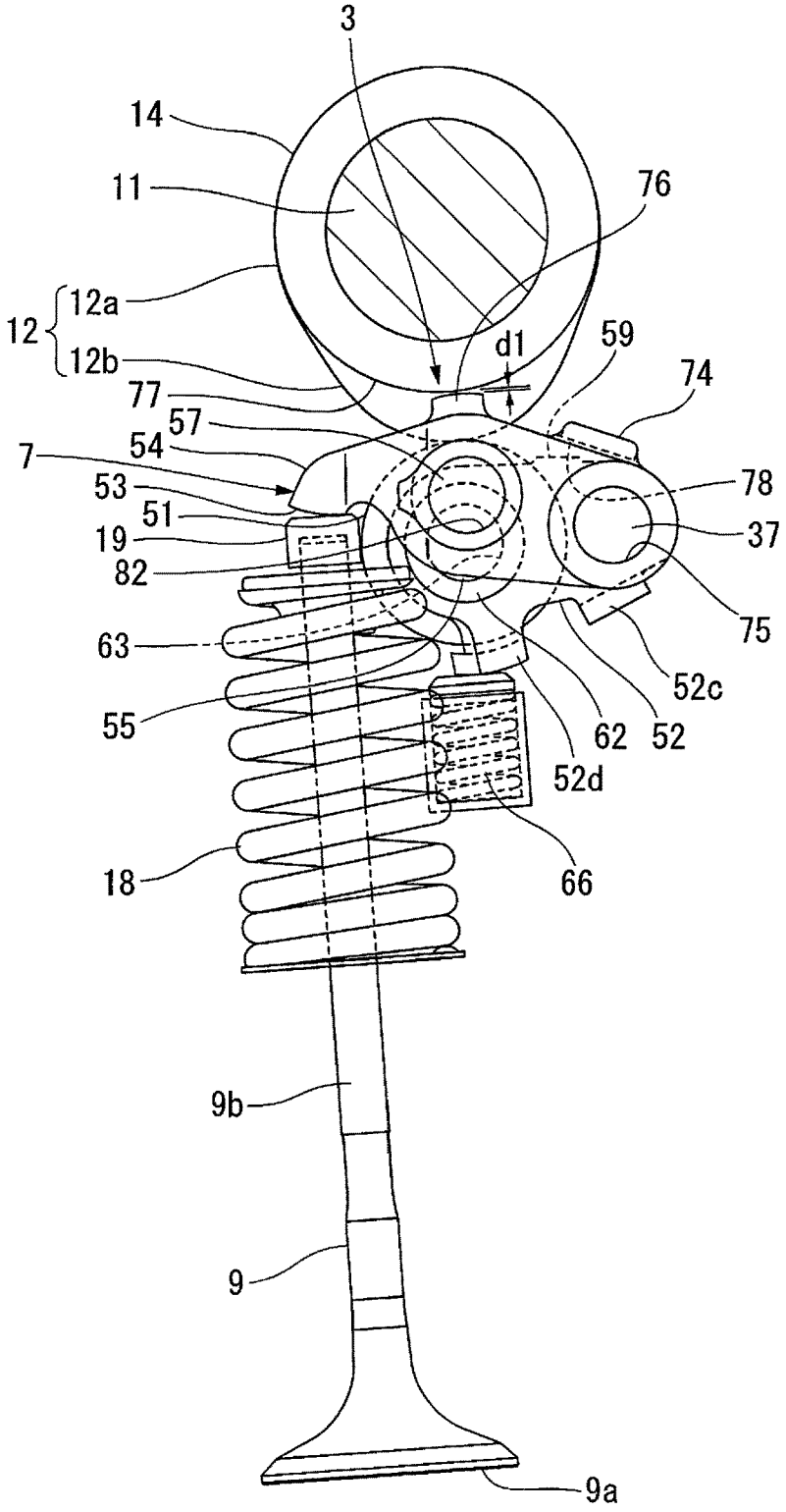
FIG. 3 is a side view for explaining a non-connected state (cylinder rest state).

The camshaft main body 11 preferably has a rod shape with a circular or substantially circular section, for example. As shown in FIG. 3, the cam 12 includes a circular or substantially circular base 12*a* and a nose 12*b*. The circular base 12*a* preferably has a shape of a column located on the same axis as the camshaft main body 11, and a size such that the valve lift amount of the intake valve 8 or the exhaust valve 9 is zero or substantially zero. The nose 12*b* preferably has a shape that projects outward in the radial direction from the circular base 12*a* by a predetermined projection amount so as to have a mountain-shaped section.

The intake valve 8 and the exhaust valve 9 each preferably include two valves per cylinder, and each valve is reciprocally supported by the cylinder head 4. The two intake valves 8 are arranged at a predetermined interval in the axial direction of the intake camshaft 5. The two exhaust valves 9 are arranged at a predetermined interval in the axial direction of the exhaust camshaft 6.

As shown in FIG. 1, the intake valve 8 includes a valve body 8*a* which opens/closes an intake port 15 of the cylinder head 4, and a valve shaft 8*b* extending from the valve body 8*a* into a valve chamber 16 of the cylinder head 4. The exhaust valve 9 includes a valve body 9*a* which opens/closes an exhaust port 17 of the cylinder head 4, and a valve shaft 9*b* extending from the valve body 9*a* into the valve chamber 16 of the cylinder head 4. The valve shafts 8*b* and 9*b* are respectively supported via valve shaft guides 8*c* and 9*c* press-fitted in a valve chamber bottom wall 16*a* of the cylinder head 4. A valve spring 18 which biases the intake valve 8 or the exhaust valve 9 in a direction to close the valve is provided between the distal end of each of the valve shafts 8*b* and 9*b* and a bottom surface 16*b* of the valve chamber bottom wall 16*a*. A cap-shaped shim 19 is provided at the distal end of each of the valve shafts 8*b* and 9*b*.

The upstream end of the intake port 15 is open to one side of the cylinder head 4. The downstream end of the intake port 15 is open to a combustion chamber 20 of each cylinder. The upstream end of the exhaust port 17 is open to the combustion chamber 20. The downstream end of the exhaust port 17 is open to the other side of the cylinder head 4. A tubular wall 21 that attaches and detaches a spark plug from above is provided in a portion corresponding to the center of the combustion chamber 20 in the cylinder head 4.

The valve chamber 16 of the cylinder head 4 is surrounded by the cylinder head 4 and a cylinder head cover 4*a* (see FIG. 1) mounted on the cylinder head 4, and is partitioned for each cylinder by partitions 22 (see FIG. 2) located between the cylinders.

As shown in FIG. 1, an intake-side journal 23 that supports the intake camshaft 5 and an exhaust-side journal 24 that supports the exhaust camshaft 6 are located in the upper end portion of each partition 22. A cam cap 25 is mounted on the journals 23 and 24 by a plurality of mounting bolts 26, for example (see FIG. 2).

The cam cap 25 rotatably supports the intake camshaft 5 and the exhaust camshaft 6 by sandwiching them with the journals 23 and 24. A camshaft support 27 including the journals 23 and 24 and the cam cap 25 is provided in each of the above-described partitions 22 between the cylinders and partitions 28 and 29 at the front end and rear end of the cylinder head 4. The front end and rear end respectively correspond to an upper end and a lower end in FIG. 2, and correspond to one end and the other end in the axial direction of the crankshaft of the engine 2.

Rocker housings 31 that support the rocker arms 7 (to be described later) are provided between the camshaft supports 27 in the cylinder head 4. The rocker housing 31 according to the present preferred embodiment is provided for each cylinder, and is fixed, by fixing bolts 33, for example, to a support wall 32 (see FIG. 1) that is integral with the cylinder head 4 across the partitions 22. As shown in FIG. 1, the support wall 32 extends in the axial direction of the crankshaft by intersecting the tubular wall 21 to attach and detach the spark plug. The upper end of the tubular wall 21 is connected to the support wall 32, and a circular or substantially circular opening connected to the interior of the tubular wall 21 is provided in the support wall 32. All of the above-described valve chamber bottom walls 16*a*, tubular walls 21, partitions 22, and support walls 32 define a portion of the cylinder head 4, and are preferably integrally molded at the time of casting of the cylinder head 4.

Figure 4:
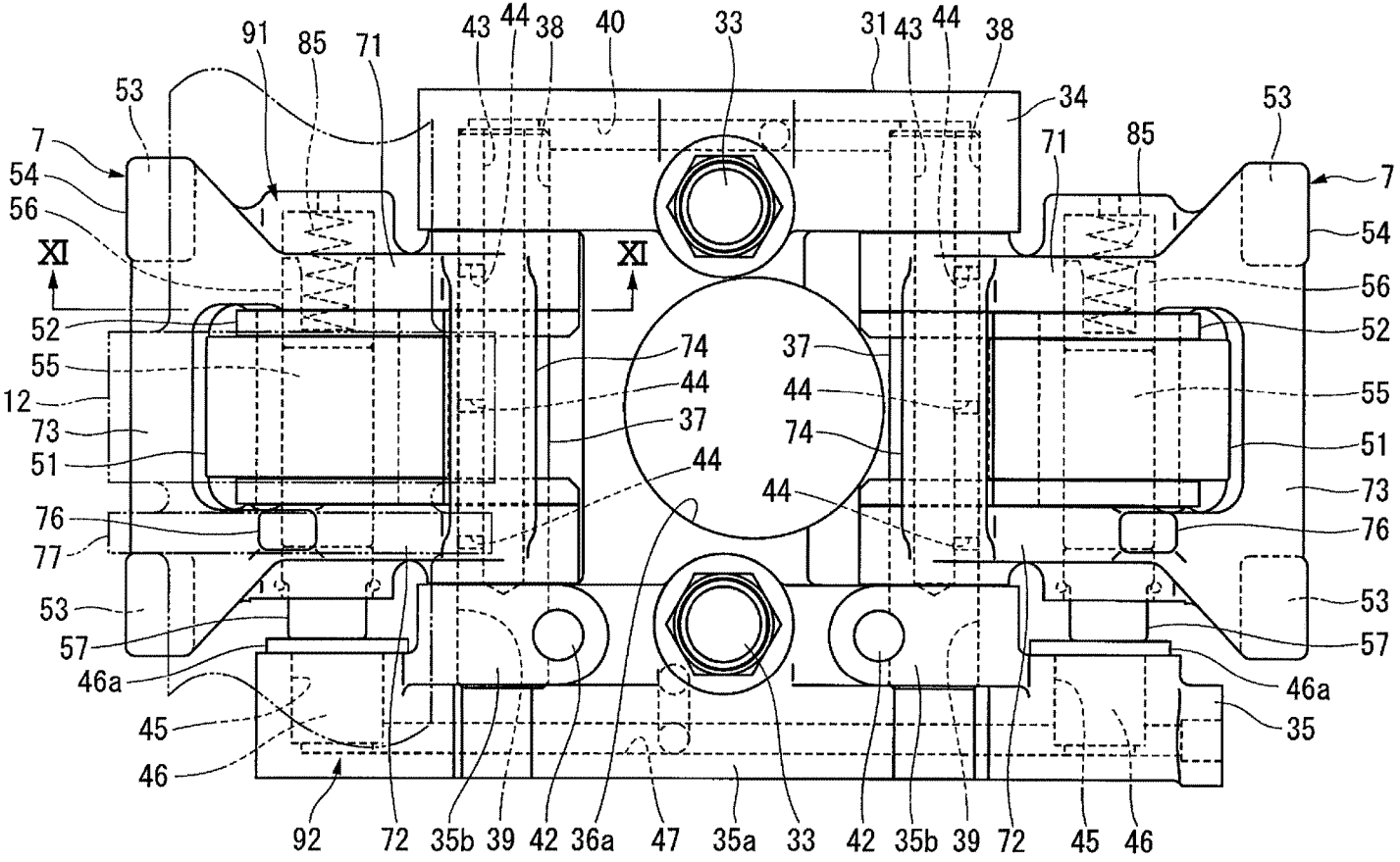
FIG. 4 is a plan view showing the valve gear.
Figure 5:
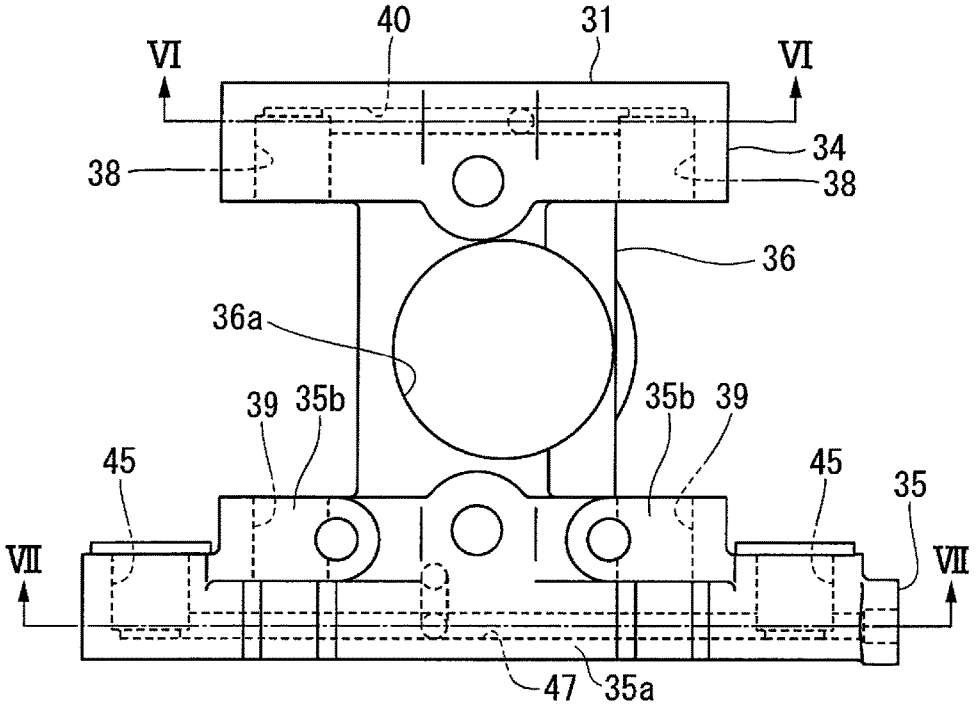
FIG. 5 is a plan view showing the rocker housing.

As shown in FIGS. 4 and 5, the rocker housing 31 includes three functional elements. These functional elements include a first rocker shaft support 34 located uppermost in FIG. 5, a second rocker shaft support 35 located lowermost in FIG. 5, and a connector 36 which connects the first rocker shaft support 34 and the second rocker shaft support 35. The first rocker shaft support 34, the second rocker shaft support 35, and the connector 36 according to a preferred embodiment of the present invention are preferably integrally formed by casting, for example.

Two circular or substantially circular holes 38 and two circular or substantially circular holes 39 in which rocker shafts 37 (see FIG. 4) are fitted are provided in the first rocker shaft support 34 and the second rocker shaft support 35, respectively. The rocker shaft 37 which supports the rocker arm 7 that drives the intake valve is inserted in one of the two circular holes 38 and one of the two circular holes 39. The rocker shaft 37 which supports the rocker arm 7 that drives the exhaust valve is inserted in the other one of the circular holes 38 and the other one of the circular holes 39.

Figure 6:
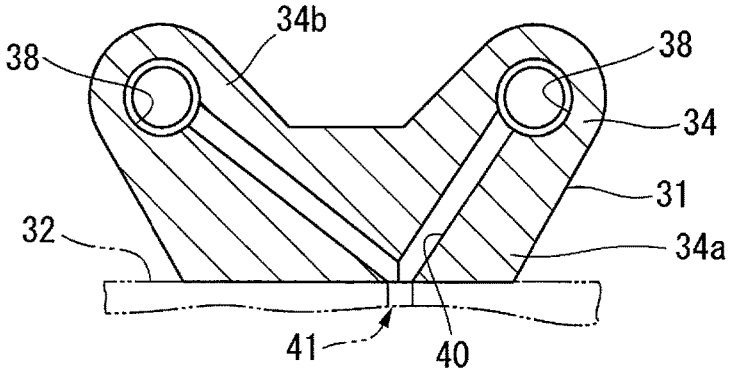
FIG. 6 is a sectional view taken along a line VI-VI in FIG. 5.

As shown in FIG. 6, the first rocker shaft support 34 includes a base 34*a* mounted on the support wall 32 and convex portions 34*b* projecting upward from the base 34*a*. The two circular holes 38 in which first ends of the rocker shafts 37 are fitted are provided in the convex portions 34*b*.

The two circular holes 38 of the first rocker shaft support 34 are non-through holes. The first ends of the rocker shafts 37 are respectively fitted in the circular holes 38. A first oil passage 40 is connected to the circular holes 38. This first oil passage 40 leads oil from an oil supply 41 (see FIG. 6) of the cylinder head 4 into the circular holes 38. The oil supply 41 is provided by a portion of the support wall 32.

Figure 7:
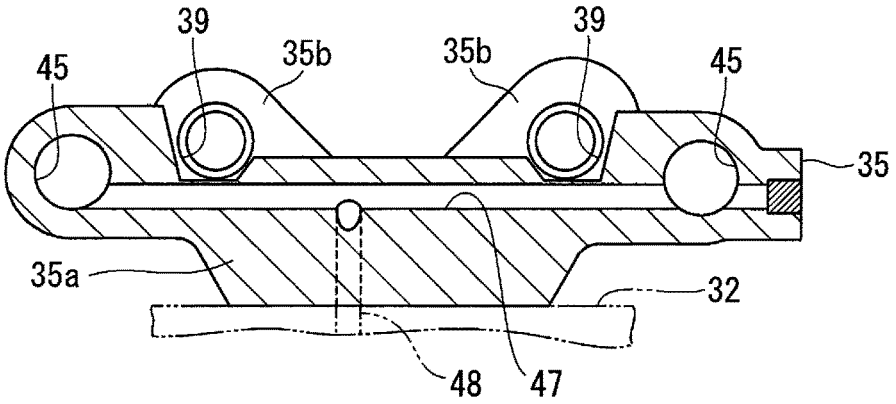
FIG. 7 is a sectional view taken along a line VII-VII in FIG. 5.

As shown in FIG. 7, the second rocker shaft support 35 includes a base 35*a* mounted on the support wall 32 and convex portions 35*b* projecting upward from the base 35*a*. The two circular holes 39 in which the second ends of the rocker shafts 37 are fitted are provided in the convex portions 35*b*. The circular holes 39 are through holes. As shown in FIG. 4, each rocker shaft 37 is engaged with a stopper pin 42 which is press-fitted in the convex portion 35*b* from above, thus implementing removal prevention and whirl-stop.

An oil hole 43 defined by a non-through hole which is open to one end (one end supported by the first rocker shaft support 34) of the rocker shaft 37 is provided in the axial portion of the rocker shaft 37. Communication holes 44 communicating between the inside and the outside of the rocker shaft 37 are located at three positions in the middle of the rocker shaft 37. Oil sent from the above-described oil supply 41 into the circular holes 38 through the first oil passage 40 is supplied outside the rocker shaft from the communication holes 44 through the oil holes 43 in the rocker shafts 37. Note that the first oil passage 40 is able to be provided in the second rocker shaft support 35. In the present preferred embodiment, the circular holes 38 of the first rocker shaft support 34 are through holes and the circular holes 39 of the second rocker shaft support 35 are non-through holes. The rocker shafts 37 are mounted on the rocker housing 31 so that the opening ends of the oil holes 43 are located in the second rocker shaft support 35.

As shown in FIG. 7, the base 35*a* of the second rocker shaft support 35 has a shape that projects toward two sides with respect to the convex portions 35*b*. Cylinder holes 45 are respectively provided in two end portions of the base 35*a*. The cylinder holes 45 are defined by non-through holes extending in parallel or substantially parallel to the axis of the camshaft 14, and are open to one side where the first rocker shaft support 34 is located. Hydraulic pistons 46 in the above-described switch 3 are movably fitted in the cylinder holes 45, respectively. The hydraulic piston 46 corresponds to a "pressing element".

A second oil passage 47 is connected to the cylinder holes 45. The second oil passage 47 connects the cylinder hole 45 on the intake valve side located on one end side of the base 35*a* and the cylinder hole 45 on the exhaust valve side located on the other end side to a hydraulic supply 48 of the cylinder head 4. The hydraulic supply 48 is provided by a portion of the support wall 32.

As shown in FIG. 4, each hydraulic piston 46 includes a pressing plate 46*a* projecting from the cylinder hole 45. The pressing plate 46*a* is larger in a direction perpendicular or substantially perpendicular to the axis of the camshaft than the cylinder hole 45.

The connector 36 of the rocker housing 31 has a plate shape extending in the axial direction of the camshaft 14. A circular hole 36*a* includes a through hole in the connector 36 to be concentrically connected to the circular hole of the above-described support wall 32.

Figure 8:
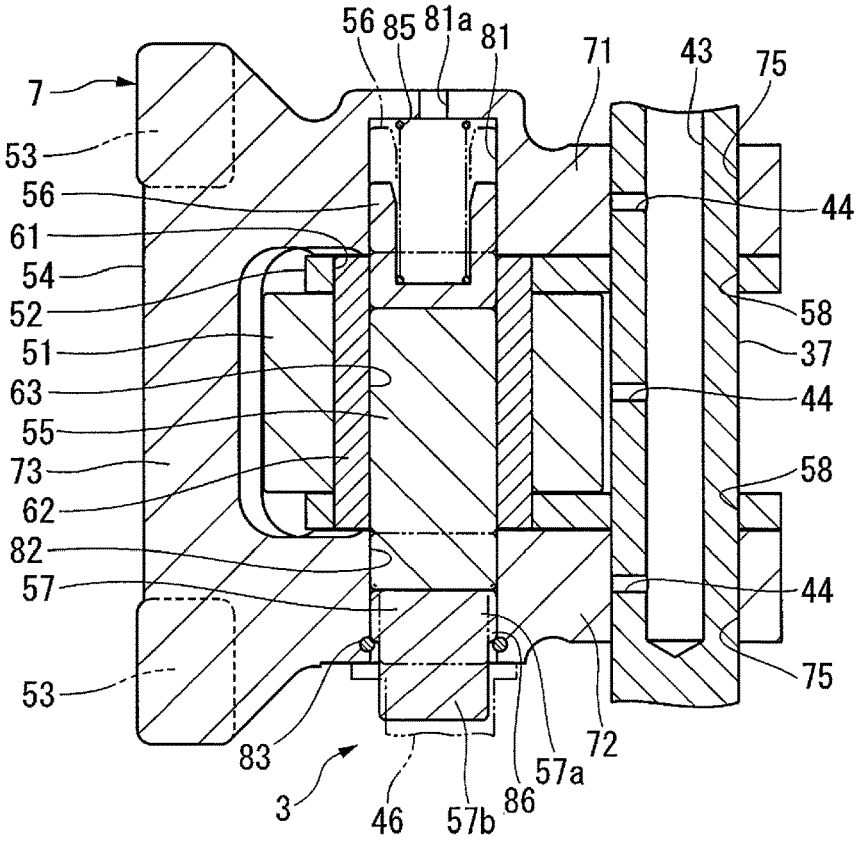
FIG. 8 is a sectional view showing a rocker arm.

As shown in FIGS. 4 and 8, each rocker arm 7 includes a plurality of elements. The plurality of elements include a first rocker arm 52, a second rocker arm 54, and first to third switch pins 55 to 57. The first rocker arm 52 includes a roller 51 which contacts the cam 12. A valve pressing portion 53 which presses the intake valves 8 or the exhaust valves 9 is provided at the swing end of the second rocker arm 54. The first to third switch pins 55 to 57 selectively connect the first rocker arm 52 and the second rocker arm 54.

Figure 9:
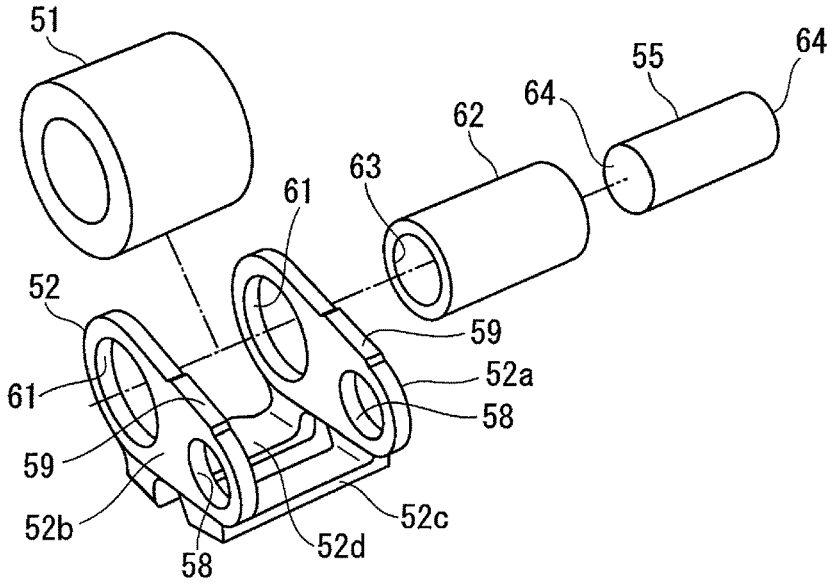
FIG. 9 is an exploded perspective view showing the first rocker arm.

As shown in FIG. 9, the first rocker arm 52 preferably has a U-shape in a front view including a first arm piece 52*a* and a second arm piece 52*b* which are swingably supported by the rocker shaft 37 and two connecting pieces 52*c* and 52*d* which connect the first and second arm pieces 52*a* and 52*b*. The rocker shaft 37 is swingably fitted in through holes 58 respectively located in the first arm piece 52*a* and the second arm piece 52*b*.

As shown in FIGS. 3 and 9, projections 59 are provided on end surfaces which are first ends, supported by the rocker shaft 37, of the first arm piece 52*a* and the second arm piece 52*b*, and are oriented toward the camshaft 14 when viewed from the axial direction of the rocker shaft 37.

The roller 51 is inserted between the first arm piece 52*a* and the second arm piece 52*b*. The roller 51 includes a cam follower which is defined by a rotation member contacting the cam 12.

The roller 51 is rotatably supported by a support shaft 62 fitted in shaft holes 61 of the first arm piece 52*a* and the second arm piece 52*b* via a needle bearing. The axis of the support shaft 62 is parallel or substantially parallel to that of the rocker shaft 37. A portion of the outer surface of the roller 51 faces the rocker shaft 37, as shown in FIG. 8. The central communication hole 44 of the above-described three communication holes 44 is provided in a portion of the rocker shaft 37 facing the roller 51.

For example, some of the oil sent into the rocker shaft 37 is ejected from the central communication hole 44 and adheres to the outer surface of the roller 51, thus lubricating the contact portion between the roller 51 and the cam 12. The communication holes 44 on two sides among the three communication holes 44 are provided in portions of the rocker shaft 37 which pass through the second rocker arm 54. Therefore, the contact portion between the second rocker arm 54 and the rocker shaft 37 is lubricated by oil flowing out from the two communication holes 44.

A first pin hole 63 defined by a through hole is located in the axial portion of the support shaft 62. The first switch pin 55 is fitted in the first pin hole 63 and movable in the axial direction of the rocker shaft 37. The first switch pin 55 preferably has a columnar shape. In addition, the first switch pin 55 is longer than the width of the first rocker arm 52 (the length of the first rocker arm 52 in the axial direction of the rocker shaft 37) by a predetermined length. A convex portion 64 (see FIG. 11) projecting from the first rocker arm 52 in the first switch pin 55 is housed in a concave portion 65 of the second rocker arm 54 (to be described later).

As shown in FIG. 3, a spring 66 is located between the cylinder head 4 and the connecting piece 52*d* of the first rocker arm 52. The spring 66 biases the first rocker arm 52 in a direction in which the roller 51 is pressed against the cam 12, for example, a return direction that is opposite to a direction in which the first rocker arm 52 swings when being pressed by the cam 12. For this reason, when pressed by the cam 12, the first rocker arm 52 swings against the spring force of the spring 66.

As shown in FIGS. 4 and 8, the second rocker arm 54 includes a first arm half 71 and a second arm half 72 which are swingably supported by the rocker shaft 37, and a first connector 73 and a second connector 74 which connect the arm halves 71 and 72. The first and second arm halves 71 and 72 and the first and second connectors 73 and 74 according to a preferred embodiment of the present invention preferably are integrally formed by integral molding, for example. The rocker shaft 37 is swingably fitted in through holes 75 respectively located in the first arm half 71 and the second arm half 72.

As shown in FIG. 8, a second pin hole 81 defined by a non-through hole is located in the middle of the first arm half 71. The second switch pin 56 is housed in the second pin hole 81, as will be described later in detail. An air hole 81*a* communicating the inside and outside of the second pin hole 81 is located on the bottom of the second pin hole 81.

A third pin hole 82 defined by a through hole is located in the middle portion of the second arm half 72. A portion of the first switch pin 55 and the third switch pin 57 are housed in the third pin hole 82, as will be described later. A circlip 83 is provided at one end (an end located on the side opposite to the first arm half 71) of the third pin hole 82. The circlip 83 corresponds to a "removal prevention member".

The first arm half 71 and the second arm half 72 are located at positions which sandwich the first rocker arm 52 from two sides in the axial direction in a state in which the first arm half 71 and the second arm half 72 are swingably supported by the rocker shaft 37. As shown in FIGS. 3 and 4, a projection 76 is provided in a middle of the second arm half 72 and is oriented toward the camshaft 14. On the other hand, a disc portion 77 is provided in a portion of the camshaft 14 facing the projection 76, as indicated by two-dot dashed lines in FIG. 4. The disc portion 77 has a disc shape with the same diameter as that of the circular base 12*a* of the cam 12, and provided at a position adjacent to the cam 12.

As shown in FIG. 3, a gap d1 is located between the disc portion 77 and the projection 76 in a state in which the valve pressing portion 53 of the second rocker arm 54 is in contact with the shim 19. When the second rocker arm 54 bounces and swings toward the camshaft 14 due to a vibration or the like, the projection 76 hits the disc portion 77 to regulate the further swinging of the second rocker arm 54.

Figure 10:
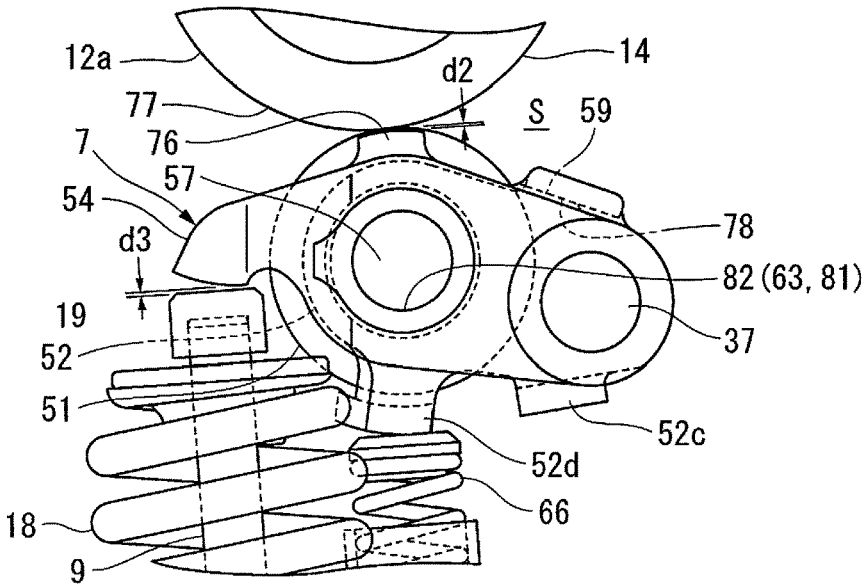
FIG. 10 is a side view for explaining a connected state while the intake or exhaust valves are closed.

As shown in FIG. 10, the projection 76 is close to the disc portion 77 of the camshaft 14 and has a slight gap d2 in a state in which the roller 51 of the first rocker arm 52 abuts against the circular base 12*a* of the cam 12. The gap d2 is narrower than the gap d1 shown in FIG. 3. In the state shown in FIG. 10, a valve clearance d3 is provided between the shim 19 and the valve pressing portion 53 of the second rocker arm 54.

The swing ends of the first arm half 71 and the second arm half 72 are connected by the first connector 73. The valve pressing portions 53 which press the shims 19 of the intake valves 8 or the exhaust valves 9 are located at two ends of the first connector 73. For example, the second rocker arm 54 simultaneously presses the two intake valves 8 or exhaust valves 9 of each cylinder.

The bases of the first arm half 71 and second arm half 72, which are supported by the rocker shaft 37, are connected to each other by the second connector 74. In a preferred embodiment of the present invention, the second connector 74 corresponds to a "connector".

As shown in FIG. 3, the second connector 74 is disposed in the first ends of the first arm half 71 and the second arm half 72, which are supported by the rocker shaft 37, and connects the portions facing the camshaft 14. As shown in FIG. 4, the second connector 74 crosses the first rocker arm 52 in a planar view. Therefore, when the first rocker arm 52 swings toward the cam 12 with respect to the second rocker arm 54, the projection 59 of the first rocker arm 52 moves closer to the second connector 74. In a preferred embodiment of the present invention, a stopper 78 (see FIG. 3) which abuts against the projection 59 of the first rocker arm 52 is provided on the lower surface (the surface opposite to the cam 12) of the second connector 74.

When the first rocker arm 52 swings by the spring force of the spring 66 in a state in which the intake valves 8 or the exhaust valves 9 are closed, the projection 59 abuts against the stopper 78. After the projection 59 abuts against the stopper 78, the first rocker arm 52 and the second rocker arm 54 are integrally biased in the return direction by the spring force of the spring 66. Thus, during this period, the first pin hole 63, the second pin hole 81, and the third pin hole 82 are aligned and maintained on the same axis. Therefore, the first to third switch pins 55 to 57 are readily and reliably switched to the connected state as the state shown in FIG. 8. The connected state indicates a state in which the first switch pin 55 moves to a position across the first pin hole 63 and the third pin hole 82, and the second switch pin 56 moves to a position across the first pin hole 63 and the second pin hole 81.

As shown in FIG. 10, the stopper 78 is located in a concave space S below the cam 12 at a stopper abutting position of the first rocker arm 52 where the projection 59 of the first rocker arm 52 abuts against the stopper 78. The concave space S indicates a space surrounded by the cam 12 of the camshaft 14, the roller 51 of the first rocker arm 52, and the rocker shaft 37 when viewed from the axial direction of the rocker shaft 37. In the following description, a state in which the projection 59 of the first rocker arm 52 abuts against the stopper 78 will simply be referred to as a "stopper abutting state."

Figure 11:
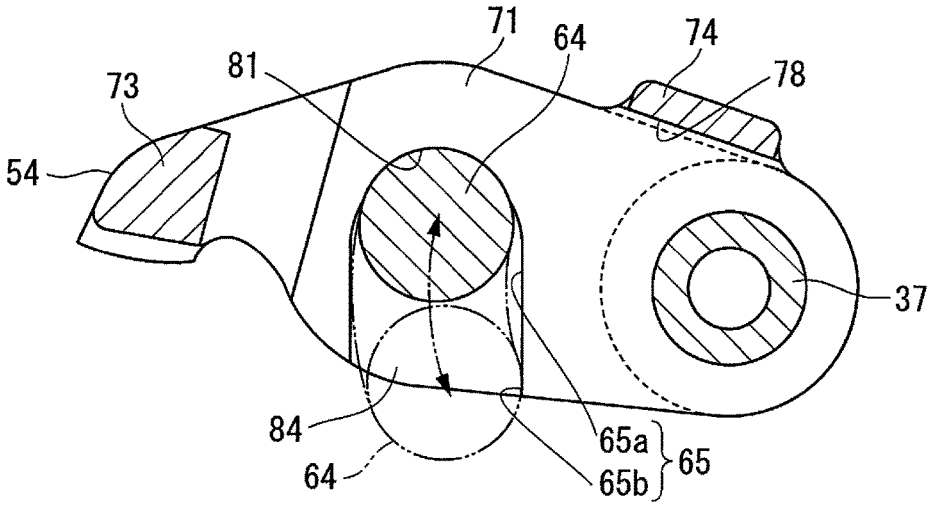
FIG. 11 is a sectional view taken along a line XI-XI in FIG. 4 and showing the second rocker arm and the first switch pin.

As shown in FIG. 11, the concave portion 65 that houses the convex portion 64 of the first switch pin 55 is provided on the inner surface of the first arm half 71 facing the first rocker arm 52. The second pin hole 81 is open inside the concave portion 65.

The concave portion 65 is provided on the inner surface of the second arm half 72 facing the first rocker arm 52, similar to the first arm half 71. The third pin hole 82 is open inside the concave portion 65. The concave portion 65 of the first arm half 71 and of the second arm half 72 preferably has the same shape at the same position when viewed from the axial direction of the rocker shaft 37.

The concave portion 65 has a groove shape extending downward from the second pin hole 81 or the third pin hole 82, and includes a plurality of functional elements. In this case, "downward" indicates a direction in which the second rocker arm 54 swings when the second rocker arm 54 presses and opens the intake valves 8 or the exhaust valves 9. The plurality of functional elements include a non-regulating portion 65*a* through which the convex portions 64 at two ends of the first switch pin 55 pass when the first rocker arm 52 swings with respect to the second rocker arm 54, and a regulating portion 65*b* which regulates the movement of the convex portion 64.

In a state in which predetermined conditions are satisfied, the non-regulating portion 65*a* has a shape that allows the first rocker arm 52 to swing with respect to the second rocker arm 54 between a swing start position and a maximum swing position without regulating the passage of the convex portion 64. The state in which the predetermined conditions are satisfied indicates a state (the non-connected state to be described later) in which the first rocker arm 52 is supported by the rocker shaft 37 and swings with respect to the second rocker arm 54.

The swing start position represents the position of the first rocker arm 52 while the roller 51 is in contact with the circular base 12*a* of the cam 12. The maximum swing position represents the position of the first rocker arm 52 while a portion where the projection amount of the nose 12*b* is largest is in contact with the roller 51.

In the above-described state in which the predetermined conditions are satisfied, the regulating portion 65*b* regulates, by regulating the passage of the convex portion 64, the swing of the first rocker arm 52 beyond the maximum swing position with respect to the second rocker arm 54. For example, as indicated by two-dot dashed lines in FIG. 11, the regulating portion 65*b* intersects the moving locus of the convex portion 64 when the first rocker arm 52 swings beyond the maximum swing position.

The regulating portion 65*b* is located in an opening 84 located on one end side of the concave portion 65 having the groove shape. The opening 84 is open in the lower direction (the direction opposite to the camshaft 14) of the second rocker arm 54. The regulating portion 65*b* is structured so that the opening width of the opening 84 is larger than the outer diameter of the convex portion 64. The convex portion 64 is able to enter and exit the concave portion 65 through the opening 84 in a state in which the first rocker arm 52 is not supported by the rocker shaft 37. For example, the regulating portion 65*b* has a shape that allows the passage of the convex portion 64 in the state in which the first rocker arm 52 is not supported by the rocker shaft 37.

As shown in FIG. 8, the second pin hole 81 and third pin hole 82 of the second rocker arm 54 extend parallel or substantially parallel to the axis of the rocker shaft 37 across the first arm half 71 and the second arm half 72.

The distance between the axis of the rocker shaft 37 and the center line of the second pin hole 81 and the third pin hole 82 matches the distance between the axis of the rocker shaft 37 and the center line of the first pin hole 63 of the first rocker arm 52. For example, the first pin hole 63, the second pin hole 81, and the third pin hole 82 are located at equidistant or substantially equidistant positions in the first rocker arm 52 and the second rocker arm 54 from the rocker shaft 37.

For example, the first pin hole 63, the second pin hole 81, and the third pin hole 82 are located on the same axis in a state in which the swing angle of the first rocker arm 52 and the swing angle of the second rocker arm 54 are predetermined angles. The predetermined angles are angles when the intake valve 8 or the exhaust valve 9 is kept closed (the valve lift amount is zero or substantially zero), and are angles in the above-described stopper abutting state.

The hole diameter of the second pin hole 81 and the third pin hole 82 matches the hole diameter of the first pin hole 63.

As shown in FIG. 8, the second switch pin 56 is movably fitted in the second pin hole 81. In addition, a spring 85 that biases the second switch pin 56 toward the first rocker arm 52 is located in the second pin hole 81. The second switch pin 56 has a closed-end cylindrical or substantially cylindrical shape, and is inserted into the second pin hole 81 in a state in which the bottom portion faces the first switch pin 55.

The second switch pin 56 has a length such that it is housed in the second pin hole 81, as indicated by two-dot dashed lines in FIG. 8. The spring 85 is provided between the inner bottom portion of the second switch pin 56 and the bottom portion of the second pin hole 81. The second switch pin 56 is pressed by the spring force of the spring 85, and is pressed against one end of the first switch pin 55 in the stopper abutting state in which the first pin hole 63, the second pin hole 81, and the third pin hole 82 are located on the same axis. In the stopper abutting state, the first switch pin 55 is pressed toward the other end by the second switch pin 56.

The third switch pin 57 is movably fitted in the third pin hole 82. In a preferred embodiment of the present invention, the third switch pin 57 and the above-described first switch pin 55 and second switch pin 56 correspond to "switch pins". The third switch pin 57 includes a large-diameter portion 57*a* facing the first switch pin 55, and a small-diameter portion 57*b* projecting from the large-diameter portion 57*a* outside the second rocker arm 54. A step 86 is located in the boundary between the large-diameter portion 57*a* and the small-diameter portion 57*b*.

The outer diameter of the small-diameter portion 57*b* is smaller than the inner diameter of the circlip 83 provided in the third pin hole 82. The distal end surface of the small-diameter portion 57*b* faces the above-described pressing plate 46*a* of the hydraulic piston 46.

The length of the third switch pin 57 in the axial direction is slightly shorter than the length of the third pin hole 82, as indicated by the two-dot dashed lines in FIG. 8. Thus, even if the hydraulic piston 46 advances until it hits the second arm half 72, the entire third switch pin 57 is housed in the second arm half 72, and two ends of the first switch pin 55 equally or almost equally project from the first rocker arm 52.

In the stopper abutting state, if the hydraulic piston 46 is in the non-operation state, the first to third switch pins 55 to 57 are pressed to the side of the hydraulic piston 46 by the spring force of the spring 85, and move to connecting positions indicated by solid lines in FIG. 8. The non-operation state of the hydraulic piston 46 indicates a state in which no oil pressure is applied to the hydraulic piston 46. The connecting positions indicate positions where the movement of the third switch pin 57 is regulated when the step 86 abuts against the circlip 83. In this state, the first switch pin 55 is located across the first rocker arm 52 and the second arm half 72 of the second rocker arm 54. Furthermore, the second switch pin 56 is located across the first rocker arm 52 and the first arm half 71 of the second rocker arm 54. When the first to third switch pins 55 to 57 are located at the connecting positions, the first rocker arm 52 and the second rocker arm 54 are connected and integrally swing about the rocker shaft 37.

Thus, the rotation of the cam 12 is converted into a reciprocating motion by the first rocker arm 52 and the second rocker arm 54, and the intake valves 8 or the exhaust valves 9 are driven. At this time, the third switch pin 57 is pressed against the circlip 83 and held at the connecting position. In addition, the third switch pin 57 moves along with the swinging of the second rocker arm 54 in a state in which a clearance is provided with respect to the pressing plate 46*a* of the hydraulic piston 46. The pressing plate 46*a* has a size such that a portion of the pressing plate 46*a* always faces the third switch pin 57 even if the first and second rocker arms 52 and 54 swing.

As shown in FIG. 4, the hydraulic piston 46 retreats to a position where the first to third switch pins 55 to 57 are not prevented from moving to the connecting positions in the non-operation state. If the hydraulic piston 46 is applied with an oil pressure, and changes from the non-operation state to the operation state, the first to third switch pins 55 to 57 are pressed by the hydraulic piston 46 to move to the non-connecting positions indicated by the two-dot dashed lines in FIG. 8. At this time, the pressing plate 46*a* of the hydraulic piston 46 abuts against the second arm half 72. The third switch pin 57 is housed in the third pin hole 82. Two ends of the first switch pin 55 slightly project from the first rocker arm 52, and enter the concave portions 65 of the first and second arm halves 71 and 72. The second switch pin 56 is housed in the second pin hole 81.

When the first to third switch pins 55 to 57 are located at the non-connecting positions, the connected state between the first rocker arm 52 and the second rocker arm 54 is canceled. In a preferred embodiment of the present invention, the first rocker arm 52 and the second rocker arm 54 are able to individually swing. Thus, as shown in FIG. 3, only the first rocker arm 52 swings when pressed by the cam 12, and the second rocker arm 54 does not swing. In this case, since the intake valves 8 or the exhaust valves 9 are kept closed, the cylinders are in the rest state.

The outer diameters of the first to third switch pins 55 to 57 according to a preferred embodiment of the present invention are set such that even if the first rocker arm 52 swings with respect to the second rocker arm 54, portions of the switch pins always face each other when viewed from the axial direction, as shown in FIG. 3.

The switches 3 provided in the valve gear 1 according to a preferred embodiment of the present invention switch between the connected state in which the first and second rocker arms 52 and 54 are connected and the non-connected state in which the rocker arms 7 are separated by moving the above-described first to third switch pins 55 to 57 in the axial direction.

As shown in FIG. 4, the switch 3 includes first pressing portions 91 and second pressing portions 92. Each first pressing portion 91 presses the first ends (the second switch pin 56) of the first to third switch pins 55 to 57 in the axial direction toward the second ends in the axial direction. Each second pressing portion 92 presses the second ends (the third switch pin 57) of the first to third switch pins 55 to 57 in the axial direction toward the first ends in the axial direction. The first pressing portion 91 according to a preferred embodiment of the present invention includes the spring 85 provided in the second rocker arm 54.

The second pressing portion 92 includes the rocker housing 31 fixed to the cylinder head 4, and the hydraulic piston 46 movably provided in the rocker housing 31 to press the distal end of the third switch pin 57. In a preferred embodiment of the present invention, the rocker housing 31 corresponds to a "support".

Figure 12:
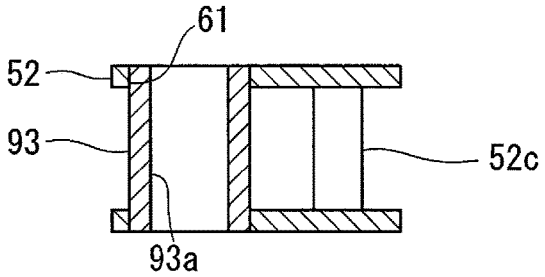
FIG. 12 is a sectional view for explaining the first step of a method of manufacturing the rocker arms.

A method of manufacturing the first rocker arm 52 and the second rocker arm 54 will be described next with reference to FIGS. 12 to 14. The manufacturing method preferably includes first to fourth steps (to be described later). In the first step, as shown in FIG. 12, a cylindrical jig 93 is fitted in the shaft hole 61 of the first rocker arm 52, instead of the support shaft 62. The cylindrical jig 93 has an outer diameter which is fitted in the shaft hole 61 of the first rocker arm 52. The cylindrical jig 93 has an inner diameter which matches that of the second pin hole 81 and third pin hole 82 of the second rocker arm 54.

Figure 13:
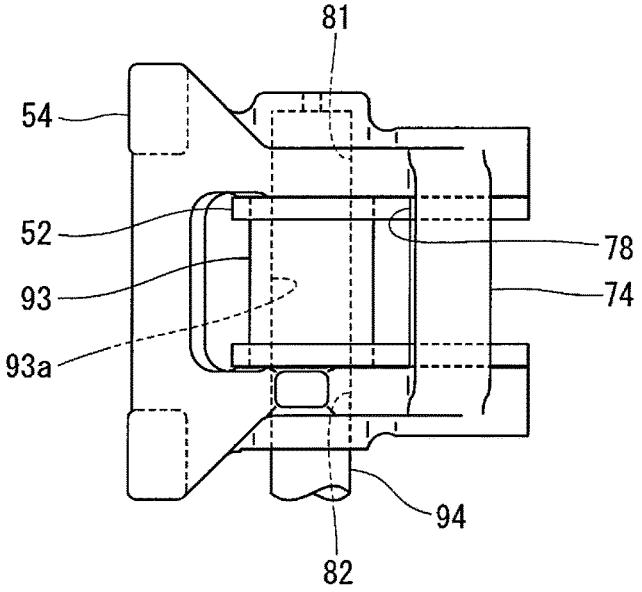
FIG. 13 is a sectional view for explaining the second and third steps of the method of manufacturing the rocker arms.

In the second step, as shown in FIG. 13, one rod-shaped jig 94 is fitted in the second and third pin holes 81 and 82 of the second rocker arm 54 and a hollow portion 93*a* of the cylindrical jig 93, instead of the first to third switch pins 55 to 57. The rod-shaped jig 94 preferably has a columnar shape with an outer diameter fitted in the hollow portion 93*a*(first pin hole 63) and the second and third pin holes 81 and 82. In the second step, the first rocker arm 52 and the second rocker arm 54 are connected via the rod-shaped jigs 94.

In the third step, as shown in FIG. 13, the first rocker arm 52 is held in a state in which it abuts against the stopper 78 of the second rocker arm 54.

Figure 14:
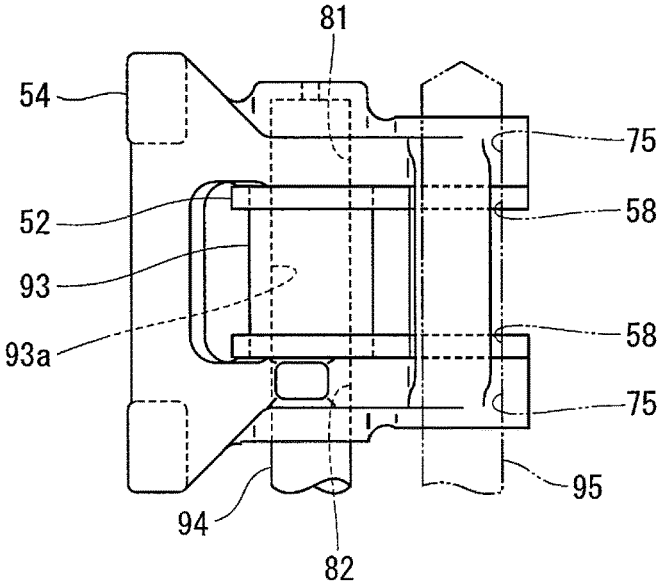
FIG. 14 is a sectional view for explaining the fourth step of the method of manufacturing the rocker arms.

In the fourth step, as shown in FIG. 14, the through holes 58 and 75 that allow the rocker shafts 37 to pass through the first rocker arm 52 and the second rocker arm 54 are made by the drills 95. For example, the drills 95 are passed through the held first rocker arm 52 and the second rocker arm 54, and holes (through holes 58 and 75) for the rocker shafts 37 are provided.

With such a manufacturing method, when the first rocker arm 52 abuts against the stopper 78 of the second rocker arm 54 in the assembled state, for example, when the intake valves 8 or the exhaust valves 9 are closed, the pin holes (first to third pin holes 63, 81, and 82) of each of the rocker arms 52 and 54 are accurately aligned.

After forming the through holes 58 and 75 in this way, and pulling the rod-shaped jigs 94 out from the first and second rocker arms 52 and 54, the assembly operation of the rocker arms 7 is performed. This assembly operation is performed by a temporary assembly step of temporarily combining the first rocker arm 52 and the second rocker arm 54 and a connecting step of passing the rocker shafts 37 through the rocker arms 52 and 54.

In the temporary assembly step, an assembly is provided by combining the first rocker arm 52 to which the roller 51 and the first switch pin 55 are assembled, and the second rocker arm 54 to which the second and third switch pins 56 and 57 and the spring 85 are assembled. At this time, the convex portion 64 of the first switch pin 55 is inserted from the opening 84 into the concave portion 65 of the second rocker arm 54.

In the connecting step, in a state in which the convex portion 64 is located in the concave portion 65, the rocker arms 7 are inserted between the first rocker shaft support 34 and the second rocker shaft support 35 of the rocker housing 31, and the rocker shafts 37 are passed through the first rocker shaft support 34 and the second rocker shaft support 35. If the first and second rocker arms 52 and 54 are supported by the rocker shaft 37, the first switch pin 55 cannot leave the concave portion 65, thus maintaining the state in which the first rocker arm 52 and the second rocker arm 54 are combined. Consequently, the rocker arms 7 are handled while being mounted on the rocker housings 31. The rocker arms 7 are assembled to the cylinder head 4 by mounting the rocker housings 31 on the support wall 32 of the cylinder head 4 by the fixing bolts 33, for example.

In the valve gear 1 for the engine 2 having the above arrangement, the first rocker arm 52 is biased by the spring 66 in a direction in which it moves closer to the cam 12. In the state in which the intake valves 8 or the exhaust valves 9 are closed, the first rocker arm 52 swings by the spring force of the spring 66, and abuts against the stopper 78 of the second rocker arm 54. At this time, while the first to third pin holes 63, 81, and 82 are located on the same axis, all the switch pins 55 to 57 are located on the same axis.

If the first to third switch pins 55 to 57 are held on the same axis, they are readily moved between the connecting positions and the non-connecting positions.

Therefore, according to a preferred embodiment of the present invention, it is possible to provide a valve gear for an engine in which the first to third switch pins 55 to 57 readily and reliably move when switching between the connected state in which the first rocker arm 52 and the second rocker arm 54 are integrated and the non-connected state in which the rocker arms are separated.

In the valve gear 1 according to a preferred embodiment of the present invention, when the first rocker arm 52 abuts against the stopper 78, the spring force of the spring 66 is transmitted to the second rocker arm 54 via the stopper 78. Then, the second rocker arm 54 is biased in the return direction by the spring force of the spring 66.

Therefore, according to a preferred embodiment of the present invention, it is possible to prevent the first rocker arm 52 from excessively swinging in the return direction, as compared with the second rocker arm 54.

The stopper 78 according to a preferred embodiment of the present invention is provided using the second connector 74 located in the base of the second rocker arm 54.

Thus, it is possible to save space, as compared with an example in which the stopper 78 is mounted on the second rocker arm 54, and readily obtain the stopper 78.

Therefore, according to a preferred embodiment of the present invention, the stopper 78 is included while reducing the weight and cost. In addition, since the second connector 74 sharing the stopper 78 is provided in the base, a moment of inertia around the rocker shaft is decreased. Consequently, the second rocker arm 54 is able to swing at high speed even though it includes the stopper 78.

Note that the position at which the stopper 78 is provided is not limited to the second connector 74. For example, the stopper 78 is able to be provided in the first or second arm half 71 or 72 or the first connector 73 of the second rocker arm 54.

The first rocker arm 52 according to a preferred embodiment of the present invention includes a cam follower (roller 51) which the cam 12 contacts. The second connector 74 is located in the concave space S surrounded by the cam 12 of the camshaft 14, the cam follower (roller 51), and the rocker shaft 37 when viewed from the axial direction of the rocker shaft 37 at the stopper abutting position of the first rocker arm 52 where the first rocker arm 52 abuts against the stopper 78 (see FIG. 10).

According to a preferred embodiment of the present invention, since the stopper 78 is provided in a dead space, the stopper 78 is mounted without increasing the size of the valve gear 1.

According to a preferred embodiment of the present invention, the concave portion 65 through which the convex portion 64 of the first switch pin 55 passes is provided on the side wall of the second rocker arm 54 facing the first rocker arm 52. The concave portion 65 includes the non-regulating portion 65*a* and the regulating portion 65*b*. In the assembled state in which the first rocker arm 52 and the second rocker arm 54 are supported by the rocker shafts 37, even if the first rocker arm 52 swings with respect to the second rocker arm 54, the first switch pin 55 cannot swing outside the concave portion 65.

Consequently, since the first switch pin 55 is never removed from the first rocker arm 52 in the assembled state, a removal prevention structure that prevents the first switch pin 55 from being removed becomes unnecessary. If it is not necessary to use the removal prevention structure, it is possible to reduce the weight and thickness of the first rocker arm 52 and simplify its structure, thus reducing the manufacturing cost. Furthermore, if the weight of the first rocker arm 52 is reduced, the spring force of the spring 66 which biases the first rocker arm 52 is able to be small, and thus a friction loss is reduced. According to a preferred embodiment of the present invention, since the support shaft 62 which rotatably supports the roller 51 is never removed, an operation of press-fitting a member, which prevents the support shaft 62 from being removed, into the first rocker arm 52 and caulking and fixing the member to the first rocker arm 52 becomes unnecessary. For example, since it is possible to prevent the support shaft 62 from being removed without performing a process in which the first rocker arm 52 is deformed, the first rocker arm 52 has a high accuracy.

If the first switch pin 55 has a length to enter the concave portion 65, this has an advantage that there is no influence of any manufacturing error of the first switch pin 55. The reason is that an error corresponding to the depth of the concave portion 65 can be allowed. Since the manufacturing error is much smaller than the depth of the concave portion 65, there is no influence of any error.

The second rocker arm 54 according to a preferred embodiment of the present invention includes the circlip 83 which contacts the step 86 of the third switch pin 57.

Thus, since it is possible to prevent the third switch pin 57 from being removed by using the circlip 83, an operation of assembling the third switch pin 57 to the second rocker arm 54 is readily performed. In addition, when the hydraulic piston 46 is in the non-operation state and the first to third switch pins 55 to 57 are at the connecting positions, the third switch pin 57 vertically swings together with the second rocker arm 54. However, at this time, the third switch pin 57 is never unnecessarily pressed against the hydraulic piston 46. Therefore, the contact portion between the third switch pin 57 and the hydraulic piston 46 is difficult to wear down.

In a method of manufacturing the rocker arms according to a preferred embodiment of the present invention, even though the diameter of the shaft hole 61 located in the first rocker arm 52 is larger than that of the second and third pin holes 81 and 82, the first rocker arm 52 and the second rocker arm 54 are arranged so that these holes are correctly located on the same axis in the assembled state. The assembled state indicates a state in which the first rocker arm 52 and the second rocker arm 54 are supported by the rocker shafts 37 and the first rocker arm 52 abuts against the stopper 78. Therefore, by assembling the valve gear 1 using the rocker arms 7 made by the method of manufacturing the rocker arms, it is possible to more readily and reliably switch between the operation in which the first rocker arm 52 and the second rocker arm 54 are integrated and the operation in which the rocker arms are separated.

Second Preferred Embodiment

Figure 15:
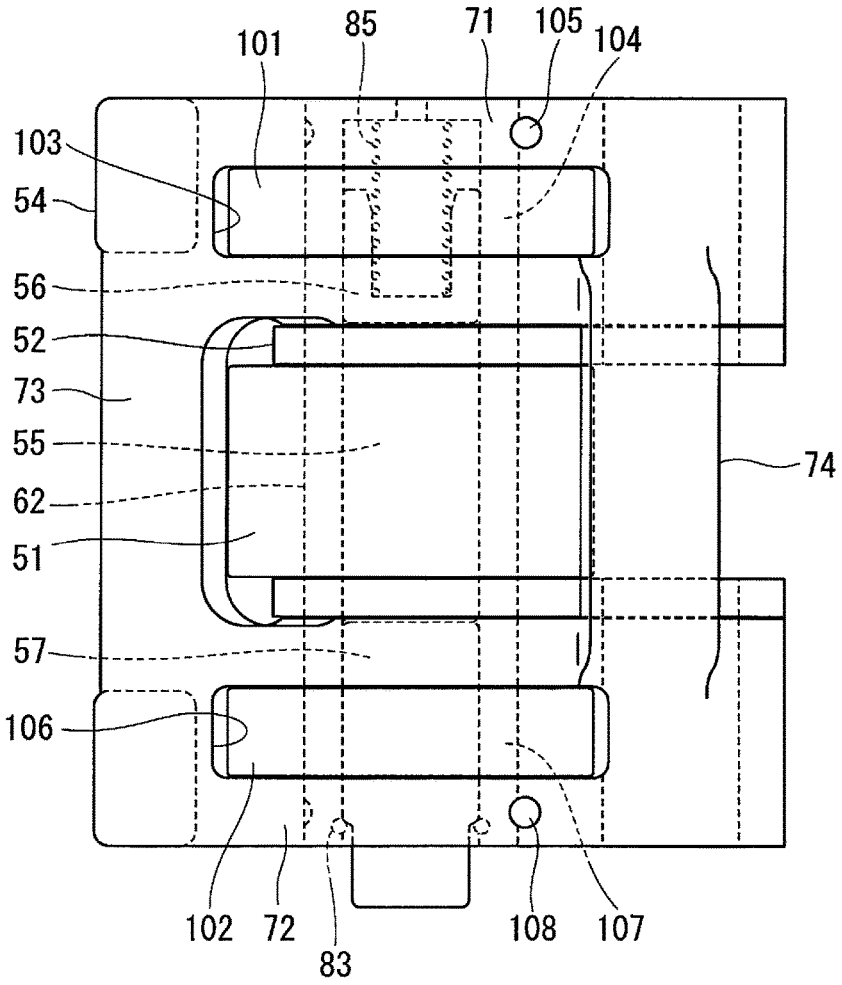
FIG. 15 is a plan view showing the first and second rocker arms according to a second preferred embodiment of the present invention.
Figure 16:
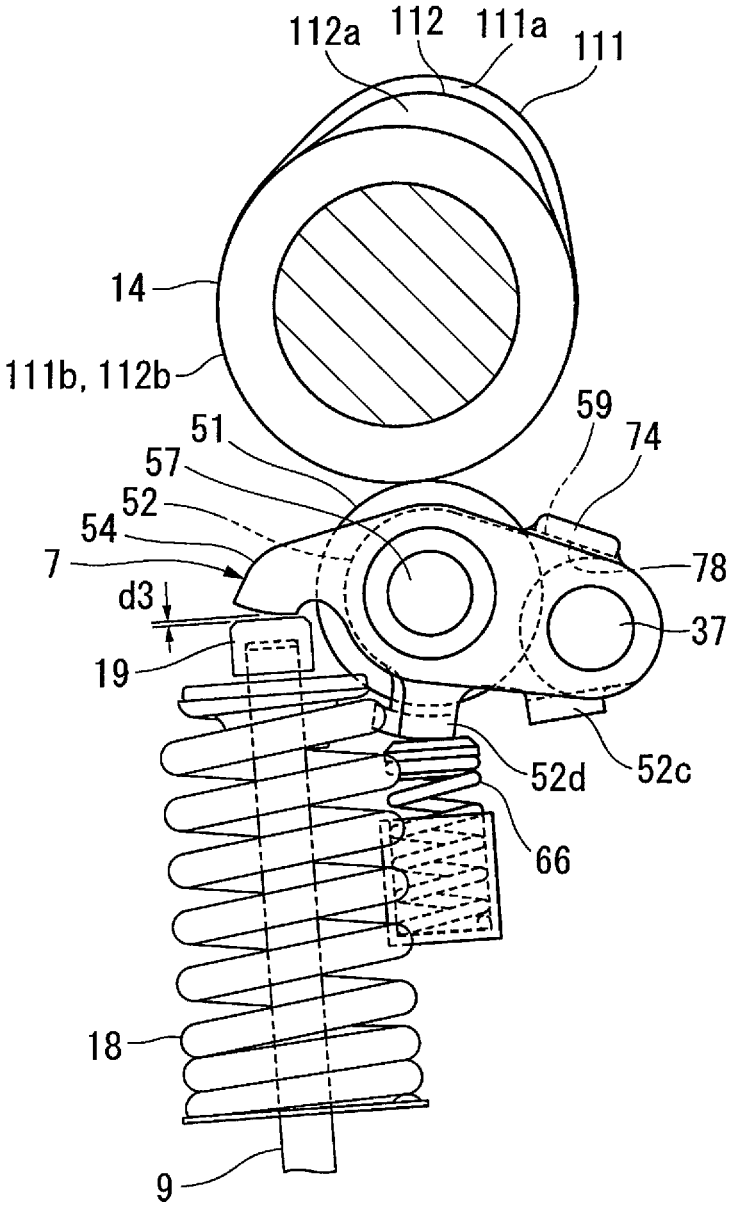
FIG. 16 is a side view showing the main portion of a valve gear according to the second preferred embodiment of the present invention.

A valve gear for an engine according to a second preferred embodiment of the present invention is shown in FIGS. 15 and 16. The same reference numerals as those of the members described with reference to FIGS. 1 to 14 denote the same or similar elements in FIGS. 15 and 16, and a detailed description thereof will be omitted.

A second rocker arm 54 according to a preferred embodiment of the present invention includes a first cam follower 101 and a second cam follower 102. Each of the cam followers 101 and 102 preferably is defined by a roller having the same diameter as that of a roller 51 of a first rocker arm 52.

The first cam follower 101 is inserted into a hole 103 located in a first arm half 71, and is rotatably supported by a first tubular shaft 104 via a bearing. The first tubular shaft 104 has a closed-end cylindrical or substantially cylindrical shape, and is fixed to the first arm half 71 by a positioning pin 105 press-fitted in the first arm half 71. While a second switch pin 56 is movably fitted in the hollow portion of the first tubular shaft 104, a spring 85 which biases the second switch pin 56 is housed in the hollow portion.

The second cam follower 102 is inserted into a hole 106 located in a second arm half 72, and is rotatably supported by a second tubular shaft 107 via a bearing. The second tubular shaft 107 has a cylindrical or substantially cylindrical shape that passes through the second arm half 72. The second tubular shaft 107 is fixed to the second arm half 72 by a positioning pin 108 press-fitted in the second arm half 72. While a third switch pin 57 is movably fitted in the inner circumferential portion of the second tubular shaft 107, a circlip 83 which regulates the movement of the third switch pin 57 is provided in the inner circumferential portion.

The first tubular shaft 104 and the second tubular shaft 107 are located on the same axis as a support shaft 62 of the first rocker arm 52 in a predetermined state. The predetermined state indicates a state in which the first rocker arm 52 and the second rocker arm 54 are supported by rocker shafts 37 and the first rocker arm 52 abuts against a stopper 78.

On the other hand, as shown in FIG. 16, a camshaft 14 according to the present preferred embodiment includes a first cam 111 which contacts the roller 51 of the first rocker arm 52, and two second cams 112 which respectively contact the first and second cam followers 101 and 102 of the second rocker arm 54. The first cam 111 includes a nose 111*a* and a circular base 111*b*. The second cam 112 includes a nose 112*a* and a circular base 112*b*.

The projection amount of the nose 112*a* of the second cam 112 is smaller than that of the nose 111*a* of the first cam 111.

According to the present preferred embodiment, when the first rocker arm 52 and the second rocker arm 54 are connected and integrated, intake valves 8 or exhaust valves 9 are driven by the first cam 111. When the first rocker arm 52 and the second rocker arm 54 are separated, the intake valves 8 or the exhaust valves 9 are driven by the second cam 112.

Therefore, according to the present preferred embodiment, it is possible to provide a valve gear for an engine which switches between the first driving operation in which the valve lift amount of the intake valves 8 or the exhaust valves 9 is large and the second driving operation in which the valve lift amount of the intake valves 8 or the exhaust valves 9 is small.

The rocker housing 31 of each of the above-described first and second preferred embodiments of the present invention is obtained by integrally forming the first and second rocker shaft supports 34 and 35 and the connector 36. These three functional elements of the rocker housing 31 may be individually provided. In a preferred embodiment of the present invention, the rocker housing 31 may be provided by connecting the first rocker shaft support 34 and the second rocker shaft support 35 to the connector 36 by bolts, for example.

Each of the above-described preferred embodiments of the present invention has explained an example in which the pressing element of the switch 3 includes the hydraulic piston 46. However, the pressing element may include a swinging lever. This lever is swingably supported by the rocker housing 31 in a state in which one swing end is in contact with the third switch pin 57 and the other end is in contact with the hydraulic piston 46. In a preferred embodiment of the present invention, the degree of freedom of the installation position of the hydraulic piston is improved.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A valve gear for an engine, comprising:

a camshaft including a cam that drives one of an intake valve and an exhaust valve;

a rocker shaft parallel or substantially parallel to the camshaft;

a first rocker arm swingably supported by the rocker shaft and that swings when pressed by the cam;

a spring that biases the first rocker arm in a return direction, which is opposite to a direction in which the first rocker arm swings when pressed by the cam;

a second rocker arm swingably supported by the rocker shaft and in which a valve pressing portion that presses one of the intake valve and the exhaust valve is located at a swing end;

pin holes that are parallel or substantially parallel to an axis of the rocker shaft and that are each located at equidistant or substantially equidistant positions in the first rocker arm and the second rocker arm from the rocker shaft;

a switch pin located in the pin holes and movable in an axial direction of the rocker shaft; and a switch that switches between a connected state, in which the switch pin crosses the first rocker arm and the second rocker arm, and a non-connected state, in which the switch pin never crosses the first rocker arm and the second rocker arm, by moving the switch pin in the axial direction; wherein the second rocker arm includes a stopper;

the first rocker arm that swings in the return direction, abuts the stopper in the non-connected state and in a state in which one of the intake valve and the exhaust valve is closed;

all of the pin holes are located on a same axis when the first rocker arm abuts against the stopper;

the switch pin includes a plurality of pins arranged on a same axis in the connected state and including a first switch pin located in the first rocker arm;

a length of the first switch in the axial direction of the rocker shaft is longer than a width of the first rocker arm in the axial direction;

a concave portion, which houses a convex portion that projects farther than the first rocker arm into the first switch pin, is located on a side wall of the second rocker arm that faces the first rocker arm;

the concave portion includes a non-regulating portion that allows the first rocker arm to swing with respect to the second rocker arm between a swing start position and a maximum swing position in a state in which the first rocker arm is supported by the rocker shaft and in the non-connected state, and a regulating portion that regulates a swing of the first rocker arm beyond the maximum swing position with respect to the second rocker arm in the state in which the first rocker arm is supported by the rocker shaft and in the non-connected state by regulating passage of the convex portion; and the regulating portion allows passage of the convex portion in a state in which the first rocker arm is not supported by the rocker shaft.

2. The valve gear for the engine according to claim 1, wherein a spring force of the spring is transmitted to the second rocker arm via the stopper when the first rocker arm abuts against the stopper; and the second rocker arm is biased in the return direction by the spring force of the spring.

3. The valve gear for the engine according to claim 1, wherein the second rocker arm includes a pair of arm halves, which sandwich the first rocker arm from two sides of the first rocker arm in the axial direction, and a connector, which is integral with the arm halves and connects bases of the arm halves that are supported by the rocker shaft; and the stopper is located in the connector.

4. The valve gear for the engine according to claim 3, wherein the first rocker arm includes a cam follower which contacts the cam; and the connector is located in a concave space surrounded by the cam, the cam follower, and the rocker shaft when viewed from the axial direction of the rocker shaft at a stopper abutting position of the first rocker arm where the first rocker arm abuts against the stopper.

5. The valve gear for the engine according to claim 1, wherein the switch includes a first pressing portion that presses one end of the switch pin in the axial direction toward the other end of the switch pin in the axial direction, and a second pressing portion that presses the other end of the switch pin in the axial direction toward the one end of the switch pin in the axial direction;

one of the first pressing portion and the second pressing portion includes a support member fixed to a cylinder head including the camshaft, and a pressing element that is movable in the support member and presses a distal end of the switch pin;

the switch pin includes a large-diameter portion that is movable in the rocker arm, and a small-diameter portion that projects from the large-diameter portion to an outside of the rocker arm and which faces the pressing element; and the rocker arm includes a removal prevention member that contacts a step located in a boundary between the large-diameter portion and the small-diameter portion.

6. A method of manufacturing rocker arms for the valve gear according to claim 1, in which a cam follower of the first rocker arm, which is contacted by the cam, is a rotation member, the rotation member is rotatably supported by a support shaft, which is fitted in a shaft hole of the first rocker arm, and a hollow portion, which defines a pin hole of the first rocker arm, is included in the support shaft, the method comprising:

fitting a cylindrical jig, instead of the support shaft, into the shaft hole of the first rocker arm, an outer diameter of the cylindrical jig fitting into the shaft hole of the first rocker arm and an inner diameter of the cylindrical jig matching that of a pin hole of the second rocker arm;

fitting a rod-shaped jig, instead of the switch pin, in the pin hole of the second rocker arm and the hollow portion of the cylindrical jig;

holding the first rocker arm in a state in which the first rocker arm abuts against the stopper of the second rocker arm; and drilling through the held first rocker arm and the second rocker arm to provide a hole for the rocker shaft to pass through.

* * * * *